United States Patent [19]

Dassler

[11] 3,967,392

[45] July 6, 1976

[54] GRIPPER ELEMENTS FOR SPORTS SHOES

[76] Inventor: Adolf Dassler, Am Bahnhof, D-8522 Herzogenaurach, Germany

[22] Filed: Nov. 13, 1974

[21] Appl. No.: 523,317

Related U.S. Application Data

[62] Division of Ser. No. 360,815, May 16, 1973, Pat. No. 3,859,739.

[30] Foreign Application Priority Data

May 24, 1972 Germany ..... 2225143
May 24, 1972 Germany ..... 2225144

[52] U.S. Cl. ..... 36/67 B; 36/67 D
[51] Int. Cl.[2] ..... A43C 15/00
[58] Field of Search ..... 36/59 R, 67 R, 67 B, 36/67 D

[56] References Cited

UNITED STATES PATENTS

| | | | |
|---|---|---|---|
| 72,534 | 12/1867 | Patton | 36/67 B |
| 1,260,142 | 3/1918 | Campbell | 36/67 B |
| 2,689,417 | 9/1954 | Bernstein | 36/67 D |

*Primary Examiner*—Patrick D. Lawson

[57] ABSTRACT

Gripper element for sports shoes especially for track shoes for use on plastics tracks, in which the element is provided with a body having one or more sharp penetrating surfaces adjacent the free end of the element and one or more support surfaces at a greater angle to the axis of the element, the support surface or surfaces preventing undue penetration of the element into a plastics track. A preferred construction comprises a body having the shape of a half barrel in which are formed a plurality of grooves the depth of the grooves increasing gradually from the free end of the element to a point approximately at the center of the length of the element and then gradually decreasing, the grooves forming the penetrating surfaces and the support surfaces.

2 Claims, 15 Drawing Figures

GRIPPER ELEMENTS FOR SPORTS SHOES

This is a division of application Ser. No. 360,815 filed May 16, 1973, now U.S. Pat. No. 3,859,739.

The invention relates to gripper elements for sports shoes and especially for track shoes for use on plastics tracks.

The nature of the plastics tracks, for the staging of sports competitions, which have existed for some time, has brought with it certain problems in the design of the sports shoes to be used thereon. The problems relate especially to the design of the spikes or gripper elements on the sports shoes of runners, jumpers, javelin throwers and the like. One of the problems is that the track holds the spikes of track shoes very firmly after the spikes have penetrated, so that turning the shoe about an axis at right angles to the track, such as would be necessary, for example, when running round a bend, is not readily possible, and pulling the spikes out also requires a relatively high force to be exerted.

For this reason, the use of conventional spikes has been discontinued for a long time for plastics tracks and a large number of proposals has also already been made for different designs of the gripper elements or outsoles of sports shoes, in order to make these suitable for use on plastics tracks. However the existing problems have hitherto not yet been solved satisfactorily. Above all, the outstanding problem still remains to reduce the retention of the track shoes in the track by the gripper elements and thereby to reduce the high strain on the feet and legs of the sports competitors without thereby also eliminating the reliable grip and safety from slipping and the possibility of high force transfer.

According to the present invention there is provided a gripper element for a sports shoe, such as a shoe for use on plastics tracks, such gripper element comprising a body having first and second ends with a longitudinal axis extending therebetween, the second end being adapted to be secured to the outsole of a sports shoe, at least one penetrating surface of said body tapering towards said first end and at least one support located between the penetrating surface and the second end but spaced from the second end, the or each support surface being disposed at a greater angle to the longitudinal axis than the penetrating surface or surfaces.

The body may take a number of shapes such as conical or pyramidal, or even be in the form of a plate with upturned sharpened edges. However, according to a preferred construction the gripper element comprises a body having first and second ends with a longitudinal axis extending therebetween, the second end being adapted to be secured to the outsole of a sports shoe, a radially outer surface of said body being defined by rotating a convex line about the longitudinal axis, so that the body is narrower at the first end than at the second end, and wherein a plurality of longitudinally extending circumferentially spaced grooves are formed in the body, the depth of the grooves increasing gradually from the first end to a point approximately centrally of the first and second ends and then gradually decreasing, so that the ends of the grooves adjacent the first end form penetrating surfaces and the ends of the grooves nearer the second end form support surfaces.

The gripper elements of the invention, when used on plastics tracks penetrate less deeply into the track and hence are also retained less than the previous gripper elements. It has been found that gripper elements of this type even in the gripped state, permit a certain turning of the shoe about an axis approximately at right angles to the track. At the same time these gripper elements can produce support against the track surface so as to generate a catapult effect and permit penetration into the track by means of sharp edges.

In order that the invention will be more fully understood, the following description is given, by way of example, reference being made to the accompanying drawings, in which.

Figure 2:
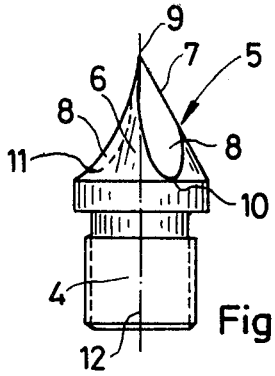
FIG. 2 is a side view of a second embodiment of gripper element.
Figure 2A:
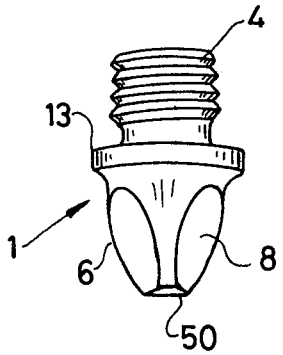
Figure 2B:
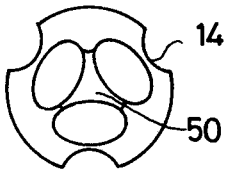
Figure 2C:
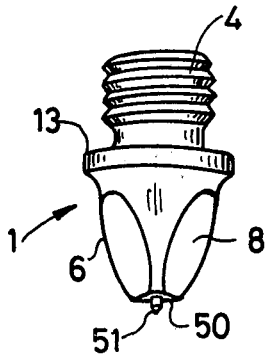
Figure 2D:
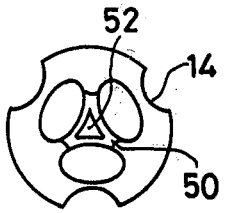

FIGS. 2*a* and 2 *b* is a perspective view and a plan view of a third embodiment;

FIGS. 2*c* and 2*d* show modifications of the embodiment according to FIGS. 2*a* and *b;*

Figure 3A:
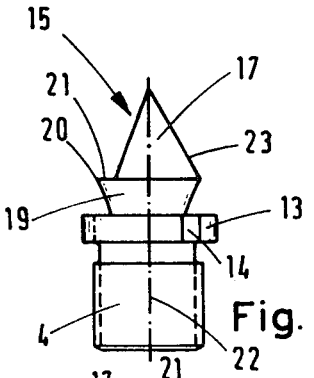
Figure 4:
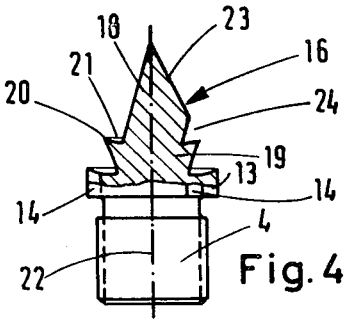
Figure 3B:
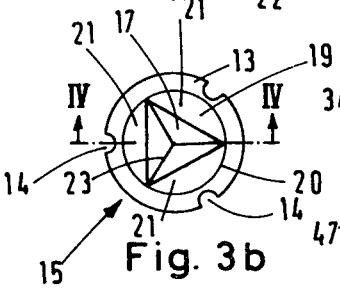

FIGS. 3*a* and 3*b* is a side view and cross-section of a sixth embodiment of a gripper element according to the invention;

FIG. 4 is a cross-section, corresponding to FIGS. 3*a* and 3*b*, along line IV-IV, through a modification of the construction of FIGS. 3*a* and 3*b;*

Figure 5A:
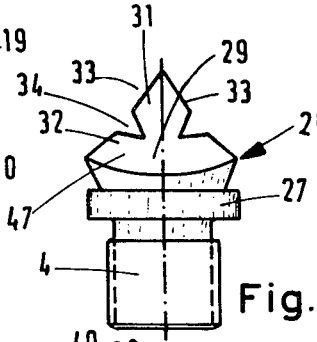
Figure 5B:
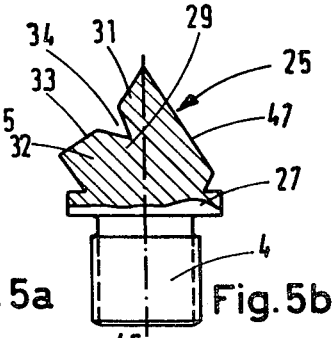
Figure 6B:
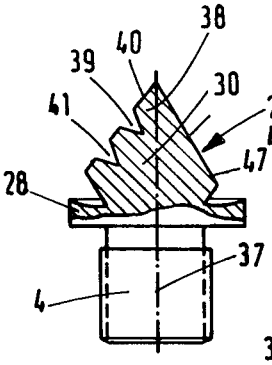
Figure 6A:
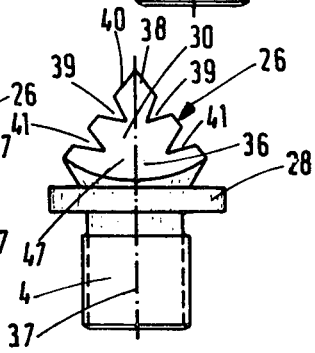
Figure 7:
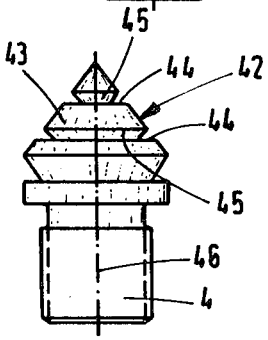
Figure 8:
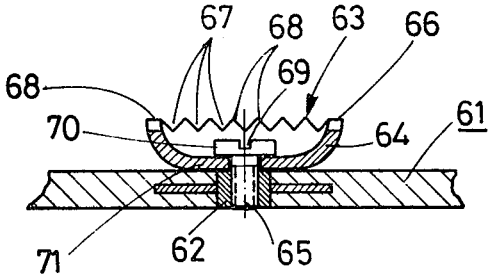
Figure 9:
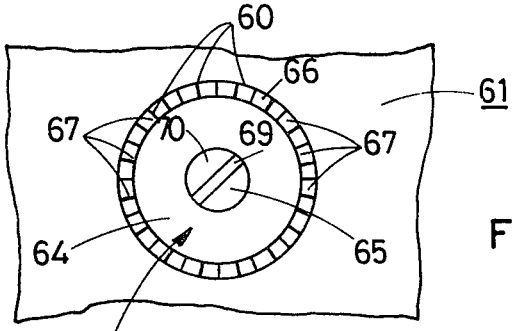
Figure 10:
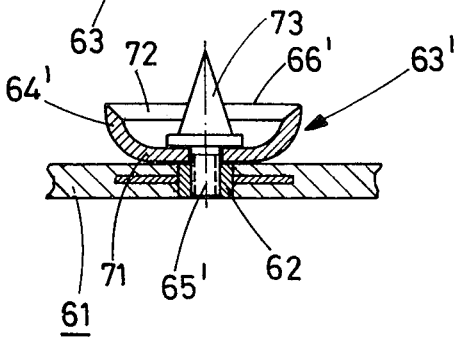

FIGS. 5*a* and 5*b* is a side view and axial cross-section of an eighth embodiment of a gripper element;

FIGS. 6*a* and 6*b* are similar views of a ninth embodiment of a gripper element;

FIG. 7 is a side view of a tenth embodiment of a gripper element;

FIGS. 8 and 9 are a cross-section and a plan view of a part of an outsole, on which is mounted an eleventh embodiment of a gripper element; and FIG. 10 is a cross-section through a part of the outsole and a twelfth embodiment of a gripper element.

FIGS. 1 to 7 represent gripper elements which resemble conventional spikes in their basic concept and the way in which they are fixed. FIGS. 8 to 10, on the other hand, show dish-shaped gripper elements with the basic characteristics of the invention.

Figure 1:
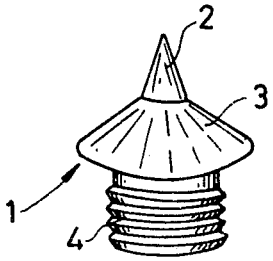
FIG. 1 shows, in perspective, a first embodiment of a gripper element according to the invention.

On the relatively simple embodiment of FIG. 1, the spike 1 has a conical, pointed penetrating end piece 2, which is effectively mounted on a frusto-conical support surface 3. The angle between the support surface 3 and the longitudinal axis of the spike is greater than the angle between the longitudinal axis of the spike and the surface of the conical penetrating surface 2. The spike 1 can be screwed into a threaded insert on the outsole of a sports shoe, by means of a threaded extension 4.

The spike 5 according to FIG. 2 consists of an originally conical front part 6, which is provided, in the present case, with three grooves 8 starting from its conical surface 7. The grooves 8 begin at the apex or first end 9 of the spike 5 and extend to the base 10 of the conical part 6. As can be seen, in particular, from the broken line 11 (on the left of FIG. 2), the depth of the grooves 8 gradually increases, starting from the apex 9 of the cone 6 and then decreases, somewhat more sharply, towards the base 10. As a result of this, the angle between the longitudinal axis 12 of the spike and the bottom of the groove 8, indicated by the broken line 11, increases relatively rapidly in the region of the spike which adjoins the outsole, so that in this region the spike offers increased resistance to penetration into the track. Of course, the support region thus formed can be as near or far from the apex 9 of the spike as is desired. All that this requires is that the shape of the bottom 11 of the grooves 8 be chosen appropriately.

The spike 5 can also, analogously to the spike 1 and in the same way as the other spikes shown in the drawing, be fixed in the outsole of the sports shoe by means of a thread 4. For this purpose, for example, a number of notches 14 for the engagement of a corresponding key are provided on a plate 14 which terminates the threaded bolt 4 (FIGS. 3*a*, 3*b* and 4).

The spike or gripper element according to FIGS. 2*a* and 2*b* is a modification of the spike according to FIG. 2, which is obtained by cutting off or flattening the apex. This produces, at the free end of the spike, a flat end surface 50 which — as can be seen from FIG. 2*b*, — is essentially triangular in shape, with slightly drawn-in sides, being defined by the bottom of the grooves 8. In this embodiment, it is thus not only the broadening bottom of the grooves 8 which serves as a support surface, but essentially also the plane 50. This plane forms edges, which act as gripper edges, with the bottom of the groove.

As can also be seen from FIG. 2*b*, the edge 6 is formed by rotating a conversely curved line about the axis of the spike, so as to be narrower at the free end. Thus the spike has the shape of a half-barrel.

The embodiments according to FIGS. 2*c* and 2*d* are again modifications of the spikes according to FIGS. 2*a* and 2*b*. According to FIG. 2*c*, a small central spike 51 additionally projects from the flat end surface 50 and assists the gripping action of the spike on the jumping board of long-jump tracks. In the embodiment according to FIG. 2*d*, on the other hand, the end surface 50 has a recess 52 which emphasises the sharpness of the gripper edges formed by the surface 50 with the grooves 8.

In the spikes 15 or 16 of FIGS. 3*a*, 3*b* and 4 the penetrating surfaces 17 or 18 are triangular this forming an end piece having the shape of a pyramid. This pyramid 17 or 18 rests on a ring, or the like, 19, the circular circumferential edge 20 of which is chosen to be of such radius that it just encloses the base surface of the pyramid 17 or 18 (FIG. 3*b*). In the regions in which the ring 19 projects beyond the base surface of the pyramid 17 or 18, support surfaces 21 are thus formed, which project radially beyond the end piece 17 or 18. In order further to increase the gripper action of the circumferential edge 20 of the support surfaces 21, the side of the ring 19 which faces the pyramid 17 or 18, that is to say also the support surface 21, can be so constructed that it is inclined from the circumferential edge 20 towards the longitudinal central axis 22 of the spike in the direction of the outsole, that is to say towards the threaded extension 4.

Whilst in the case of the spike of FIGS. 3*a* and 3*b* the pyramid 17 rests on the ring 19 with its entire base surface, the design in the spike 16 in FIG. 4 is such that a notch 24 is provided at the edges 23 of the pyramid which would extend to the circumferential edge 20 of the ring 19. Thus, in this embodiment, the sharp edge 20 of the ring 19 effectively projects somewhat, on all sides, beyond the pyramid 17.

In the spikes 25 of FIGS. 5*a* and 5*b* and 26 of FIGS. 6*a* and 6*b* the design is such that a body 29 or 30 which in total is approximately pyramidal projects, as a gripper body, beyond the ring 27 or dish 28 in which the thread 4 terminates on the track side. Preferably, this pyramid 29 or 30 is a tetrahedron.

In the embodiment according to FIGS. 5*a* and 5*b*, the pyramid 29 consists of a more pointed penetrating end piece 31 and an adjoining, blunter support piece 32. To improve the supporting action, notches 34 are provided between the end piece 31 and the support piece 32 in the region of the edges 33 of the pyramidal part 29. As can clearly be seen from the drawing, the lower surface 35 which here serves as a support surface, analogously to the surfaces 21 in FIGS. 3 and 4, is inclined downwards and towards the outsole, so that a relatively sharp edge is produced at the transition from the edge 33 to the surface 35.

The spike 26 in FIGS. 6*a* and 6*b* is very similar to the spike 25 in FIGS. 5*a* and 5*b*. It only differs from the latter in that the angle between the outer surface 36 of the spike 26 and the central axis 37 of the spike remains the same over the entire length of the pyramidal body 30. The end piece 38, analogously to the end piece 31 of FIGS. 5*a* and 5*b*, is again separated by notches 39, in the region of the edges 40 of the pyramidal body 30, from the part of the pyramidal body which is nearer the outsole.

In addition to the notches 39 which define the end piece 38, the spike 26 of FIGS. 6*a* and 6*b* also possesses further notches 41, nearer the outsole. Both the notches 39 and the notches 41 form support surfaces which present increased resistance to the penetration of the spike into the track, as compared to the resistance presented to the end piece 38. In using the spike 26, long-distance runners will generally only bring the support surfaces formed by the notches 39 into action, whilst the support surfaces formed by the notches 41 will only come into action for short-distance runners and heavier athletes, since these press the spike more deeply into the track in order thus to achieve a particularly strong catapult effect. In order to give an idea of the actual size of the spikes, it should again be pointed out here that the free end piece 38, that is to say the distance from the apex of the spike to the transition from the bottom surface of the notch 39 into the edge 40, is about 3 mm.

The spike 42 shown in FIG. 7 is based on the same principles as the spikes of FIGS. 5 and 6. It differs from the spike of FIGS. 6*a* and 6*b* in that the gripper body 43 is approximately conical in shape, with the cone 43 which forms support edges 44 or support surfaces being provided with circumferential grooves 45, which appropriately form certain undercuts corresponding to the notches 39 and 41 of the FIGS. 6*a*, 6*b*, so that the support surfaces 44 are inclined towards the spike axis 46 and to the outsole.

The flattened faces 47 which the spikes of FIGS. 5*a* to 6*b* possess have the additional advantage, over the spike of FIG. 7, that they provide particularly good support in running round bends, where a relatively strong centrifugal effect can be felt. On the other hand, applications are also conceivable in which the conical embodiment of FIGS. 1 and 2 may be more appropriate. In particular, such spikes have the advantage that even after replacement they again automatically assume precisely the correct position.

Of course it is possible to make a series of modifications to the spikes according to the invention. In particular, the angle of inclination of the penetrating end piece and of the optionally adjoining blunter support part can be widely modified to achieve particularly favourable grip properties. The spikes according to the invention can be manufactured from the most diverse materials, preferably from hard metal but, where appropriate, even of plastics. Finally, as can be seen from the drawings, the spikes need not consist of a single piece. Rather, it would also be possible to compose the spikes of several parts, for example so that the end piece has a threaded extension and at least one ring which forms at least one support surface and is sharp-edged on the side in contact with the track can be put onto the end piece and is then fixed against the outsole by means of the end piece. If, in that case, several rings of different diameter, and end pieces of different design, are used, the most diverse spikes can be composed from a few individual parts. A further possibility is that the ring 14, 27 or dish 28 in which the thread 4 terminates is also provided with a sharp outer edge, which can additionally even be serrated. Furthermore, the actual apex of the spike could also be somewhat rounded or flattened in other embodiments than those shown in FIGS. *2a – 2b*.

The embodiments according to FIGS. 8 to 10 now show modified gripper elements, the fundamental design of which no longer resembles a spike.

Threaded inserts 62 are fixed, for example injection-moulded, in the usual manner into the outsole 61 of the sports shoe, which outsole is immaterial to the present invention and is therefore merely shown as a single layer in FIGS. 8 and 10. The actual gripper elements 63, 63' are each constructed as a plate 64 or 64', with the peripheral edge turned up axially as can be seen from FIGS. 8 and 10. A threaded bolt 65 or 65' serves to fix them to the threaded insert 62.

In the embodiment of FIGS. 8 and 9 the edge 66 of the dish-shaped plate 64 which is in contact with the serrated track to provide with a plurality of notches 67, between which approximately radial sharp edges 68 are then in each case produced. Of course, the shape of the notches 67 can be varied. The edge 66 of the dish-shaped plate 64 which is in contact with the track forms a penetrating surface of the gripper element, whilst the action of the plate 64 on the inside, where there is a transition to the bottom of the plate 64, is, as can be seen from the drawing, that of the support surface which prevents excessively deep penetration of the gripper element into the track.

The dish-shaped plate 64 is fixed by a threaded bolt 65 in the form of a customary screw having a slit 69 in the head 70. To improve the hold of the gripper element 63, especially in a sideways direction, relative to the outsole 61, the bottom 71 of the dish-shaped plates 64 or 64' is flattened. Of course, it would also be possible to make the plate 64 in a different shape, for example part of a sphere.

The embodiment shown in FIG. 10 differs from that according to FIGS. 8 and 9 in that the edge 66' of the dish 64' does not have any notches but forms, over its entire periphery, a sharp edge produced by the chamfered surface 72. Here, this chamfered surface already, in a sense, represents a support surface.

The dish 64' according to FIG. 10 is fixed by means of a threaded bolt 65', the head of which is constructed as a spike 73, which projects beyond the plane formed by the edge 66' of the dish 64'. Advantageously, the spike 73 which forms the head of the threaded insert 65' can be provided, at the side, with flattened surfaces and can, for example, be in the shape of a pyramid. Of course it would also be possible to fix the dish 64 of the embodiment according to FIGS. 8 and 9 with a spike 73 — analogously to FIG. 10 — and not with a normal screw. On the other hand, the dish 64' of the embodiment according to FIG. 10 could be fixed with a customary screw and not with the spike 73. Finally, it would also be possible to make the spike 73 of a different shape, especially suitable for the particular end use.

The diameter and material of the dish 64 are chosen to suit the particular requirements. Furthermore, the dish 64, can be provided on the inside or outside, with stiffening ribs to increase its stability of shape. The stiffening ribs can be produced either merely by appropriate shaping, keeping the wall thickness approximately constant, or by increasing and reducing the thickness of the wall of the dish 64.

I claim:

1. A gripper element for a sports shoe for use on plastics tracks, said gripper element comprising a substantially circular plate-like body having first and second faces, an upstanding peripheral portion at said body on one of said faces thereof, said peripheral portion having a rim provided with a plurality of radially extending sharp edges and a plurality of notches respectively extending between said edges.

2. In combination: an outsole of a sport shoe, for use on plastics tracks, and at least one gripper element integral with said outsole, said gripper element comprising a substantially circular plate-like body having first and second faces, an upstanding peripheral portion at said body on one of said faces thereof, said peripheral portion having a rim provided with a plurality of radially extending sharp edges and a plurality of notches respectively extending between said edges.

* * * * *